US005581854A

United States Patent [19]

Swain

[11] Patent Number: 5,581,854

[45] Date of Patent: Dec. 10, 1996

[54] INVISIBLE ZIPPER

[75] Inventor: Henry L. Swain, Bridgewater, N.J.

[73] Assignee: Illinois Tool Works Inc., Glenview, Ill.

[21] Appl. No.: 342,699

[22] Filed: Nov. 21, 1994

[51] Int. Cl.[6] ..... A44B 19/00

[52] U.S. Cl. ..... 24/587; 24/400; 24/576; 383/63

[58] Field of Search ..... 24/587, 400, 399, 24/615, 616, 456, 704.1, 20 R, 16 R, 455, 287, 23 EE, 27 D; 383/63, 65; 411/338, 339; 5/402, 403, 404

[56] References Cited

U.S. PATENT DOCUMENTS

| | | | |
|---|---|---|---|
| 1,719,856 | 7/1929 | Sipe | 24/400 |
| 2,409,489 | 10/1946 | Hurt | 383/63 |
| 3,216,029 | 11/1965 | Fritzmeier | 5/403 |
| 3,517,702 | 6/1970 | Mueller et al. | 24/587 |
| 3,928,898 | 12/1975 | Smoot | 5/404 |
| 5,187,843 | 2/1993 | Lynch | 24/587 |
| 5,195,222 | 5/1993 | Rink | 5/403 |
| 5,293,672 | 3/1994 | Tominaga et al. | 24/400 |

FOREIGN PATENT DOCUMENTS

| | | | |
|---|---|---|---|
| 0799146 | 8/1958 | United Kingdom | 24/587 |
| 1197270 | 7/1970 | United Kingdom | 24/399 |

*Primary Examiner*—Victor N. Sakran
*Attorney, Agent, or Firm*—Kane, Dalsimer, Sullivan, Kurucz, Levy, Eisele and Richard, LLP

[57] ABSTRACT

A zipper intended for use in auto seat covers and the like includes a male half and a female half. The male half has a male interlocking member and a web and a tab extending substantially parallel to one another in a direction opposite to that of the male interlocking member. The web and the tab define a first channel behind the male interlocking member. In like manner, the female half has a female interlocking member and a web and a tab extending substantially parallel to one another in a direction opposite to that in which the female interlocking member faces. The web and the tab define a second channel behind the female interlocking member. The male and female halves may be joined to and interlocked with one another through compression applied in a direction substantially parallel to the webs and directed through the first and second channels. In use, a sheet material, such as fabric, leather or vinyl, is attached to the web on at least one of the male and female halves, and is joined therewith to the other of the two halves.

8 Claims, 3 Drawing Sheets

INVISIBLE ZIPPER

BACKGROUND OF THE INVENTION

1. Field of the Invention

The present invention relates to zippers comprising male and female interlocking profiles extruded from synthetic polymeric resin materials. More specifically, it is a zipper of this variety intended for use in closing out automobile seat covers in a manner invisible to, or hidden from, the casual viewer. The zipper profiles include webs to which a seat cover material may be connected, or attached, in a conventional manner.

2. Description of Prior Art

At present, automobile seat covers are closed out using conventional zippers comprising interlocking teeth and a pull tab. While strong and reliable, and capable of being closed in an unsupported situation, conventional zippers are very difficult to hide completely from view. Auto manufacturers, as a consequence, place them in the back of seats, or in some other position that may not be as noticeable.

Yet, driven by the preference to make such zippers less apparent, auto manufacturers have long searched for alternatives to conventional zippers for use in closing out seat covers. So-called J-bar and arrow fasteners provide a good alternative, but carry the disadvantage that they require a support surface against which they may be fastened. This hampers their use in auto seat covers, as much of the interior of an auto seat is either empty, or filled with quite resilient foam.

The present invention provides a solution to these problems of the prior art.

SUMMARY OF THE INVENTION

Accordingly, the present invention is an invisible, or unseen, zipper comprising a male half and a female half. The male half comprises a male interlocking member and, extending in a direction opposite to that of the male interlocking member, a web and a tab. The web and the tab are substantially parallel to one another, and define a first channel behind the male interlocking member.

The female half comprises a female interlocking member and, extending in a direction opposite to that of the opening of the female interlocking member, a web and a tab. The web and the tab are again substantially parallel to one another and define a second channel behind the female interlocking member.

The male and female halves may be joined to and interlocked with one another through compression applied in a direction substantially parallel to the webs and directed through the first and second channels.

The present zipper has been designed for use in closing out the covers of seats in automobiles and trucks. To its advantage, the zipper is invisible, meaning hidden or unseen in the finished product, as it resides on the inside of the seat cover. All that may be seen is a line where the two sides of the seat cover being joined abut against one another.

More importantly, the present zipper may be closed in an unsupported situation. That is to say, the zipper may be closed without the necessity of resting or leaning it upon a firm and substantially unyielding surface. For this reason, it has distinct advantages for use in auto seat covers, as much of the interior of an auto seat is either empty or filled with resilient foam.

The present invention will now be described in more complete detail with frequent reference being made to the drawing figures to be identified below.

DETAILED DESCRIPTION OF THE PREFERRED EMBODIMENT

Figure 1:
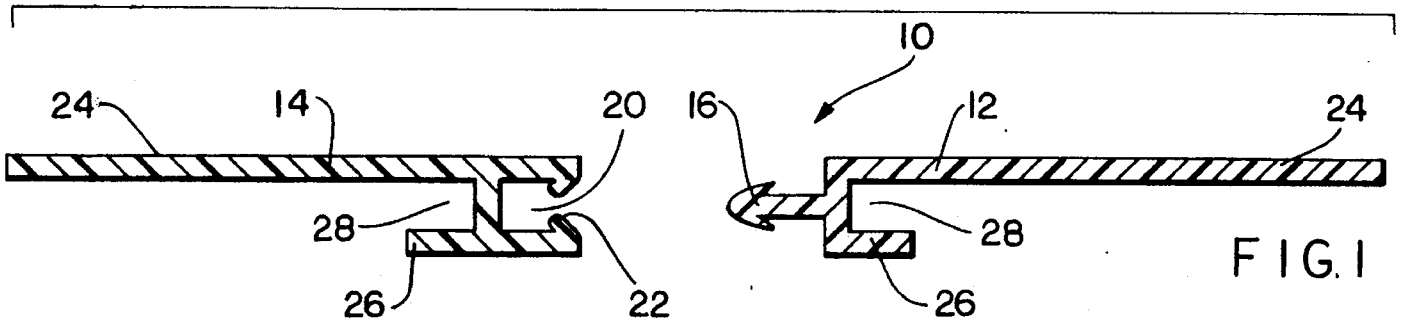
FIG. 1 is a cross-sectional view of the two unjoined halves of the invisible zipper of the present invention.

Referring now to the accompanying figures, FIG. 1 is a cross-sectional view of the two unjoined halves of the invisible zipper of the present invention. As mentioned above, the word "invisible" should be interpreted to mean "hidden", as the zipper is hidden from view in its final position of use, where it may be used to join two pieces of fabric, leather or vinyl from behind the two pieces relative to the viewer.

The zipper 10 comprises a male half 12 and a female half 14. The male half 12 includes a male interlocking member 16, which may, as illustrated, be in the form of an arrowhead. The female half 14 includes a female interlocking member 20, which may be in the form of a receptacle into which the male interlocking member 16 may be inserted. Barbs 22 prevent the male interlocking member 16 from being easily removed from the female interlocking member 20 once they are joined as shown in FIG. 2.

Both the male half 12 and the female half 14 include web portions 24 to which a fabric, leather or vinyl may be sewn or otherwise attached, such as by welding or by an adhesive. It will be noted that the male interlocking member 16 is oriented in a direction parallel to the plane of the web 24, and becomes inserted into the female interlocking member 20 by movement and compression in that same direction.

Figure 5:
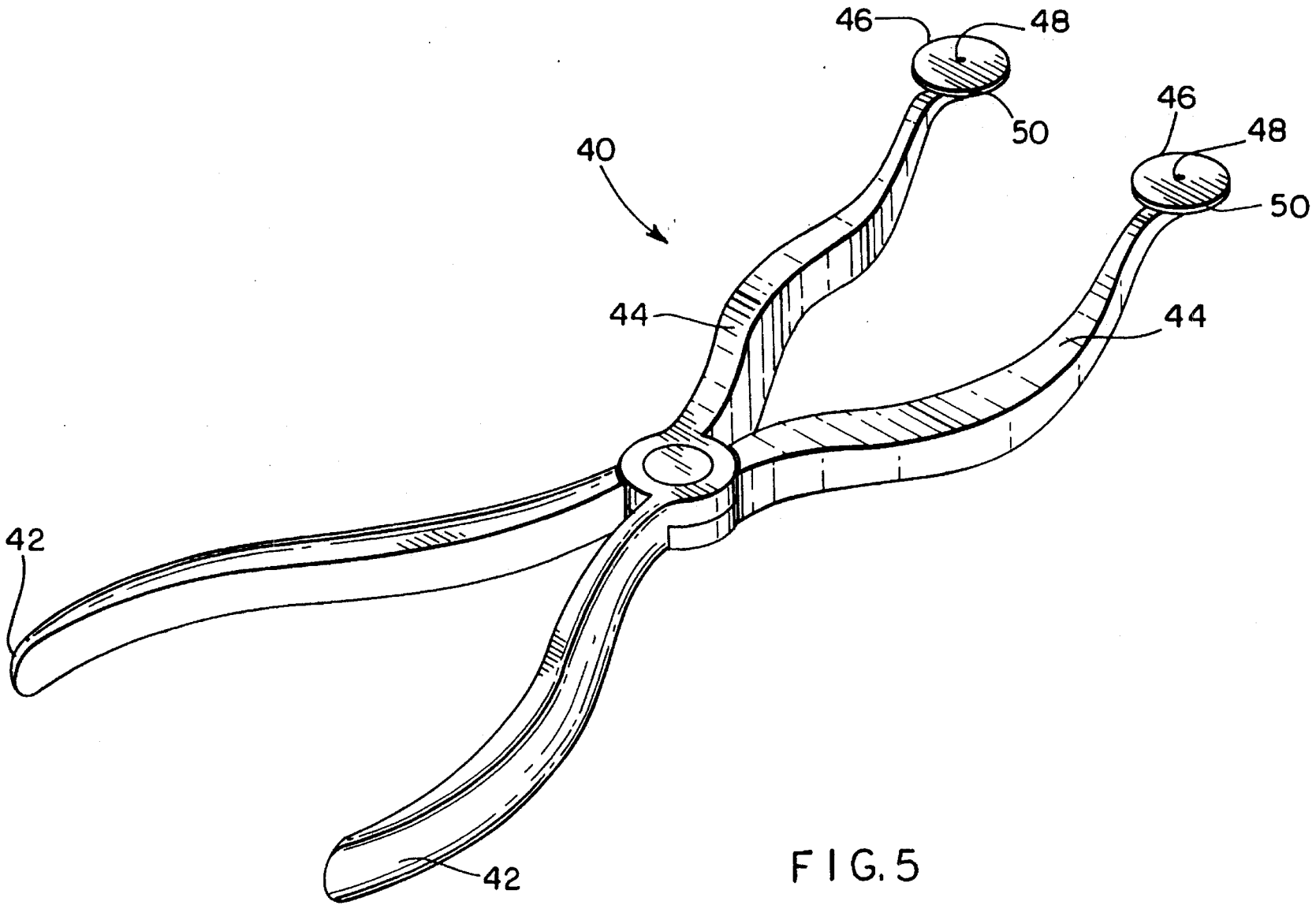
FIG. 5 is a perspective view of a tool which may be use to close the zipper of the present invention.

Parallel to the web 24 on both the male half 12 and the female half 14 is a tab 26, both the web 24 and tab 26 extending in the same direction away from the male interlocking member 16 and female interlocking member 20. The webs 24 and tabs 26 define a channel 28 behind each of the male and female interlocking members 16, 20. The channels 28 are provided as guides for a suitable tool, one example of which is illustrated in FIG. 5, to enable the male half 12 to be joined to the female half 14 quickly and reliably under conditions where the person performing the task may not be able to see the zipper 10, because it is hidden from view. In general, a suitable tool would both compress the male half 12 and female half 14 together, and, while maintaining the necessary compression, be run along the length of the zipper 10, guided by channels 28, to join the male and female halves 12, 14 together along their entire length.

Figure 2:
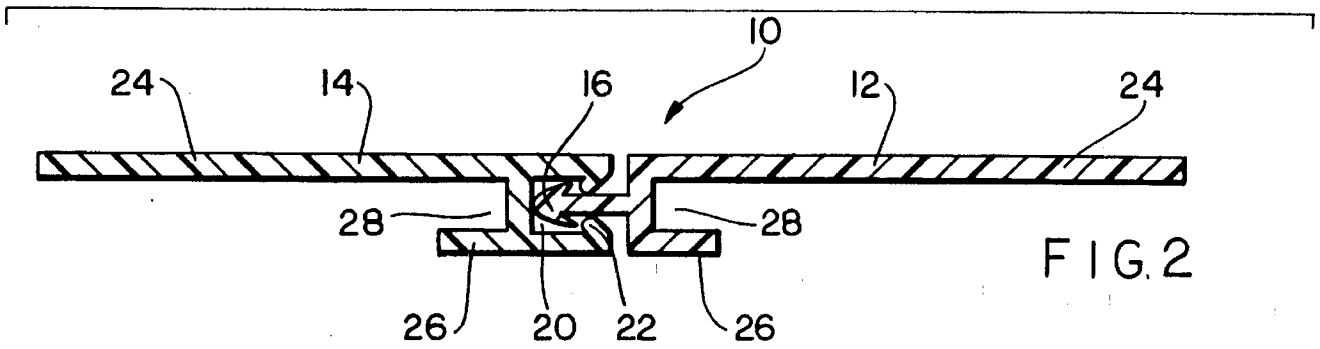
FIG. 2 is a cross-sectional view of the two halves joined together.
Figure 3:
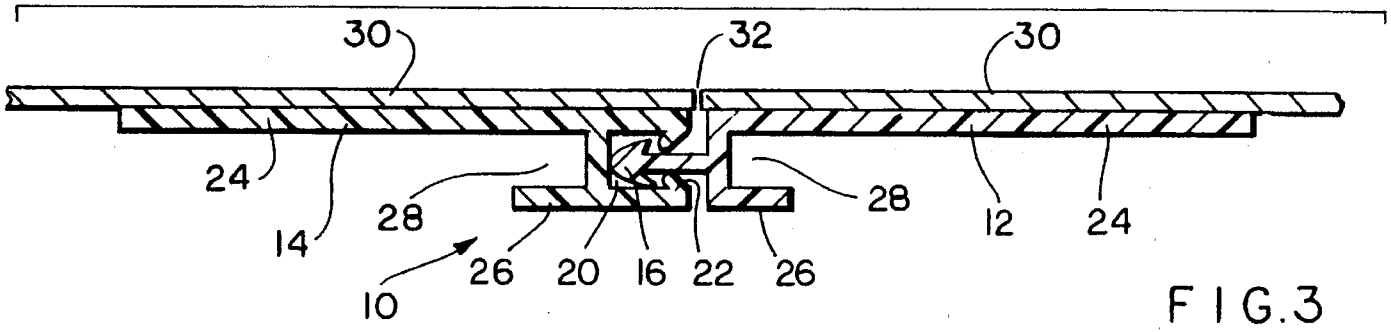
FIG. 3 is a cross-sectional view of the zipper being used in the manner for which it has been designed.

FIG. 2, as previously noted, is a cross-sectional view of zipper 10 taken when the male and female halves 12, 14 have been joined in this manner. FIG. 3 shows a similar view corresponding to the situation in which the zipper 10 may actually be used. Sheet material 30, which may be fabric, leather or vinyl, is attached by suitable means, such as by sewing, welding or by an adhesive, to webs 24 such that, when the male and female halves 12, 14 are joined as shown, only a small gap 32, if any, remains between sheet materials 30. It should be understood that the sheet material 30 faces the viewer, such as the viewer of the back of an automobile seat, while the zipper 10 is hidden (invisible) from the viewer.

It must be observed that the present zipper 10 has the advantage that it may be closed in an unsupported position. That is to say, there is no requirement for a rigid backing surface to support sheet material 30 while two pieces of same, such as those shown in FIG. 3, are joined together, as is the case with some prior-art joining devices. With the present zipper 10, two pieces of sheet material 30 may be joined by forcing the male and female halves 12, 14 together at a point, and then by maintaining that force by running along the male and female halves 12, 14 along their lengths. Since the necessary force is in the plane of the sheet materials 30, and of the webs 24 to which they are attached, the sheet materials do not have to be held against a supporting member.

Figure 4:
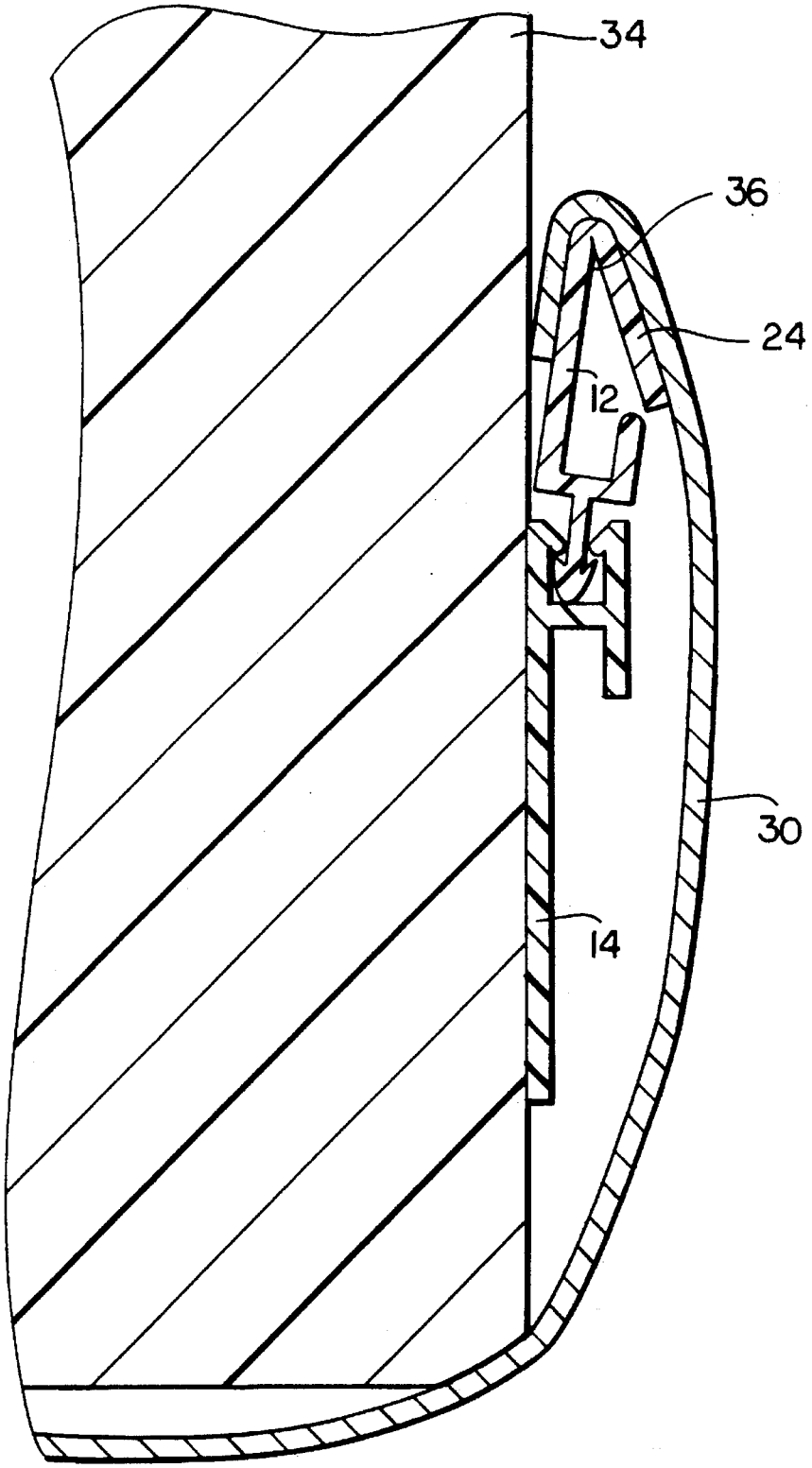
FIG. 4 is a cross-sectional view of an alternate embodiment of the present invention.

This should not be understood to imply that the present zipper 10 will never be used in a supported situation. Referring to FIG. 4, the female half 14 is shown attached to a supporting member 34, which may be a plastic seat frame member, although it is equally possible for the male half 12 to be so attached. In any case, the male or female half 12, 14 may be attached to supporting member 34, or may be integrally molded therewith.

The other of the male and female halves 12, 14, or the male half 12 as shown in FIG. 4, has a web 24 which may be bent back upon itself at point 36. Sheet material 30 is attached to web 24 so as to overlie point 36. The male half 12 may then be inserted into the female half 14, and web 24 of the male half 12 may be bent, at point 36, so that sheet material 30 may be wrapped around supporting member 34, as shown.

The zipper 10 of the present invention, or, more precisely, the male and female halves 12, 14 thereof, may be extruded from synthetic polymeric resin materials, or may be molded therefrom. Vinyl, polyethylene, especially high-density polyethylene, and polypropylene are but three examples of the materials that may be used.

FIG. 5 is a perspective view of a tool 40 which may be used to join the male and female halves 12, 14 of zipper 10. The tool 40, resembling and operable in the manner of a pair of pliers, includes handles 42 for gripping by a user, and arms 44, movable with respect to one another as the user manipulates the handles 42.

At the end of each arm 44 is a disc 46, disposed thereon in a manner that permits its rotation about a central pin 48. The pins 48, and therefore the axes of rotation of the discs 46 are parallel to one another. Further, the discs 46 lie in a common plane. Finally, the thickness 50 of the discs 46 is less than or equal to the width of channels 28 in the male and female halves 12, 14. Accordingly, the user may with tool 40 engage a disc 46 within each channel 28, may then squeeze the male and female halves 12, 14 together to join them to one another at a point, and, maintaining the force squeezing the halves 12, 14 together run along the length of the zipper 10 to close it along its length. This final step is made easier by virtue of the fact that the discs 46 are disposed to rotate.

Modifications to the above would be obvious to one of ordinary skill in the art, but would not bring the invention as so modified beyond the scope of the appended claims.

What is claimed is:

1. A zipper comprising a male half and a female half, said male half comprising a male interlocking member, and a web and a tab extending in a direction opposite to that of said male interlocking member, said web and said tab being substantially parallel to one another and defining therebetween a first channel, said first channel being behind said male interlocking member, and said female half comprising a female interlocking member, and a web and a tab extending in a direction opposite to that in which said female interlocking member faces, said web and said tab being substantially parallel to one another and defining therebetween a second channel, said second channel being behind said female interlocking member, whereby said male and female halves are joined to and interlocked with one another through compression applied in a direction substantially parallel to said webs and directed through said first and second channels, wherein said web of said male half, said web of said female half, and an outer surface of said female interlocking member are coplanar when said male and female halves are interlocked with one another.

2. A zipper as claimed in claim 1 wherein said web of one of said male and female halves is attached to a support structure.

3. A zipper as claimed in claim 1 wherein said web of one of said male and female halves is an integral part of a support structure.

4. A zipper as claimed in claim 1 wherein at least one of said male and female halves is extruded from a synthetic polymeric resin material.

5. A zipper as claimed in claim 4 wherein said synthetic polymeric resin material is vinyl.

6. A zipper as claimed in claim 4 wherein said synthetic polymeric resin material is polyethylene.

7. A zipper as claimed in claim 4 wherein said synthetic polymeric resin material is polypropylene.

8. A zipper as claimed in claim 1 wherein said web of at least one of said male and female halves is adapted to be attached to a sheet material.

* * * * *